US006023048A

United States Patent [19]

Song et al.

[11] Patent Number: 6,023,048

[45] Date of Patent: Feb. 8, 2000

[54] COOLING FURNACES FOR STRIP PRODUCTS

[75] Inventors: Rummeng Song, Nandy; Patrick Dubois, Andrezelle; Michel Boyer, Chartrettes; Françoise Onno, Metz; Charlie Lespagnol, St Pierre Bruck; Akli Elias, Thionville, all of France

[73] Assignees: Stein Heurtey, Ris-Orangis, France; Sollac, La Defense, France

[21] Appl. No.: 09/234,442

[22] Filed: Jan. 21, 1999

[30] Foreign Application Priority Data

Feb. 9, 1998 [FR] France ..... 9801497

[51] Int. Cl.[7] ..... F27B 9/28; F27B 9/36; C21D 9/56; C21D 9/573

[52] U.S. Cl. ..... 219/388; 226/103; 432/59; 148/657; 148/658; 148/661

[58] Field of Search ..... 219/388; 148/111, 148/112, 559, 601, 602, 641, 657, 658, 661; 266/103, 104, 90; 29/335; 432/236, 246, 59

[56] References Cited

U.S. PATENT DOCUMENTS

| | | | |
|---|---|---|---|
| 5,230,857 | 7/1993 | Cook et al. | 266/90 |
| 5,472,528 | 12/1995 | Boyer . | |
| 5,985,212 | 4/1999 | Fujikura et al. | 432/59 |

FOREIGN PATENT DOCUMENTS

| | | |
|---|---|---|
| 59-76830 | 5/1984 | Japan . |
| 59-207346 | 11/1984 | Japan . |
| 62-253734 | 11/1987 | Japan . |
| 2-277727 | 11/1990 | Japan . |
| 3-20417 | 1/1991 | Japan . |
| 5-78756 | 3/1993 | Japan . |
| 8-003650 | 1/1996 | Japan . |

*Primary Examiner*—Joseph Pelham
*Attorney, Agent, or Firm*—Pollock, Vande Sande & Amernick

[57] ABSTRACT

Apparatus which eliminates the risk of forming wrinkles on a strip conveyed through a cooling furnace of a continuous heat-treatment plant, especially an annealing or galvanizing furnace, through which the strip is conveyed by rolls, the latter being heated by contact with the strip over its width, the risk of forming wrinkles occuring during a change of strip width when the following strip is wider, the latter consequently passing over rolls that have preserved the imprint of the thermal expansion due to the previous strip, wherein the heating elements are positioned close to and beneath the rolls, over the entire width of the furnace, and, on the opposite side of the rolls from the said heating elements, panels are positioned which are aligned so as, together with the wall of the furnace, to form a warm chamber, the continuously moving strip serving as a heat shield so that only that part of the roll which is not covered by the strip is heated by the said heating elements.

7 Claims, 3 Drawing Sheets

COOLING FURNACES FOR STRIP PRODUCTS

FIELD OF THE INVENTION

The present invention relates to improvements to cooling furnaces used in plants for the heat treatment of metal strip products, especially in systems of continuous galvanizing or annealing furnaces through which the strip to be treated is conveyed by means of rolls.

BRIEF DESCRIPTION OF THE PRIOR ART

FIG. 1 of the appended drawings shows, very diagrammatically, a cooling furnace denoted in its entirety by the reference 10 through which the strip 12 travels continuously, passing over rolls such as 14.

In the chamber of the cooling furnace 10 there is a temperature difference between the strip 12, which is hot, and the rolls 14. When the strip 12 passes over the rolls 14, it heats them, by contact, over a region which corresponds to the width of the strip. In this regard, reference may be made to FIG. 2 of the appended drawings which shows, in perspective, the wrapping of the strip 2 around a roll 14.

The distribution of temperatures along the longitudinal axis of the roll therefore has the shape of a bowler hat. FIG. 3*a* of the appended drawings shows the temperature variation of the roll along its longitudinal axis. It follows from such a temperature distribution that the surface of the roll also adopts a bowler-hat shape due to the effect of thermal expansion. FIG. 3*b* of the appended drawings shows the variation in the diameter of the roll due to the effect of this thermal expansion along the longitudinal axis of the roll (the variation has been exaggerated in order to show this phenomenon more clearly).

When there is a change of width of the strip 12, and if the following strip is wider, it therefore passes over rolls 14 which have retained the "imprint" of the thermal expansion due to the previous strip and there is then a risk of forming wrinkles in the new strip.

The technical problem that the present invention aims to solve is that of eliminating this risk of forming wrinkles in the new strip, during a change of strip width, in such strip-product cooling chambers.

The risk of forming wrinkles disappears if the rolls, such as 14, have a uniform temperature during changes of strip width. In order to obtain a uniform temperature over the rolls 14 of the cooling chamber, either the central part of the roll over the width of the strip must be cooled, which is extremely difficult to carry out, or the parts of the roll outside the width of the strip must be heated.

In order to reduce the risk of forming wrinkles in a strip during a width change, the following techniques are presently used:

- the strip is made to run more slowly during the width change: this technique has the drawback of resulting in a loss of production because of this slow-down;
- the rolls are internally heated, e.g. by an internal electrical heating element: this generally results in the rolls being complicated and expensive to manufacture and this technique can be used only for a few strip widths; moreover, this technique requires the position of the strip on the rolls to be very stable.

BRIEF SUMMARY OF THE INVENTION

The invention aims to provide a simple, effective and inexpensive solution to the abovementioned problem of forming wrinkles during a change of strip width.

Consequently, the invention relates to an apparatus which eliminates the risk of forming wrinkles on a strip conveyed through a cooling furnace of a continuous heat-treatment plant, especially an annealing or galvanizing furnace, through which the strip is conveyed by rolls, the latter being heated by contact with the strip over its width, the risk of forming wrinkles occurring during a change of strip width when the following strip is wider, the latter consequently passing over rolls that have preserved the imprint of the thermal expansion due to the previous strip, this apparatus being characterized in that the following are positioned: heating elements close to and beneath the rolls, over the entire width of the furnace, and, on the opposite side of the rolls from the said heating elements, panels that are aligned so as, together with the wall of the furnace, to form a warm chamber, the continuously moving strip serving as a heat shield so that only that part of the roll which is not covered by the strip is heated by the said heating elements.

According to a preferred embodiment of the present invention, the said heating elements are made in the form of electric heat plugs.

According to the present invention, the rolls may be heated by the said heating elements continuously or intermittently depending on the frequency of the changes of strip width, the said heating elements operating continuously during frequent changes of width and intermittently during infrequent changes of width, the heating being used for a predetermined time immediately before the change of width.

According to the present invention, the operation of the said heating elements is controlled in real time by a computer.

Other features and advantages of the present invention will emerge from the description given below with reference to the appended drawings which illustrate one embodiment thereof, this being devoid of any limiting character.

Figure 1:
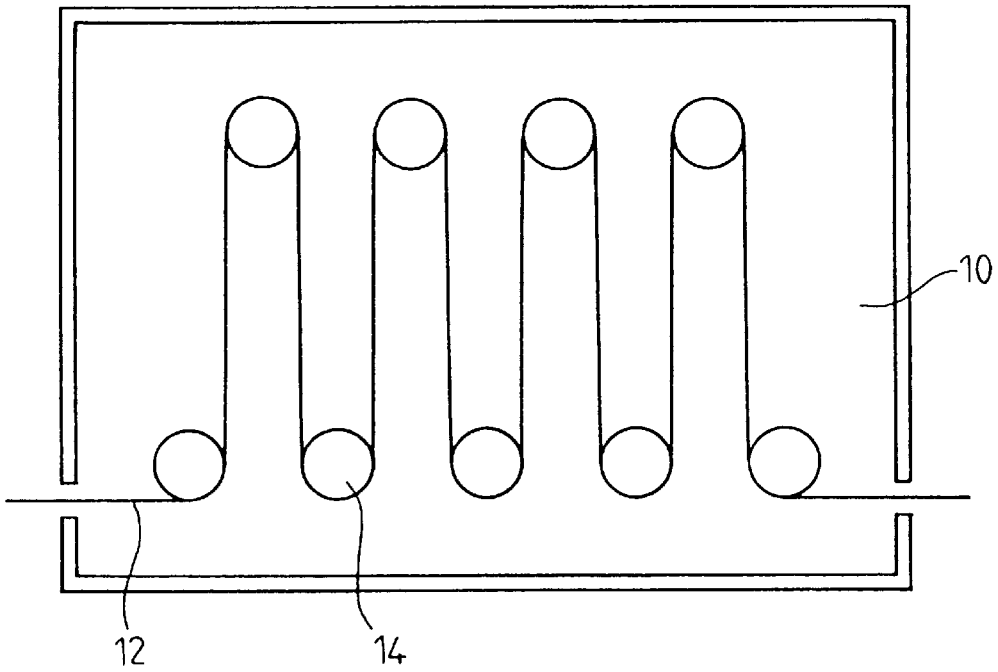
FIG.1 PRIOR ART
FIG. 1 is a diagrammatic view of a cooling chamber in which the present invention is applied.
Figure 2:
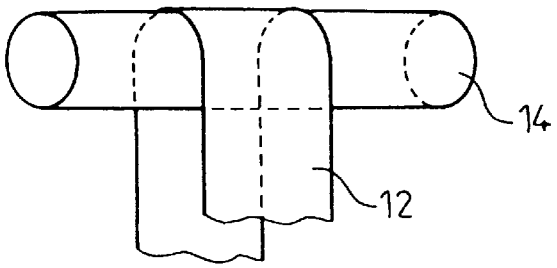
FIG.2 PRIOR ART
FIG. 2 is a partial perspective view showing the wrapping of the strip to be treated over a roll, this figure having been used in the preamble of the present description so as to explain the reasons for the risk of forming wrinkles in the strip.
Figure 3A:
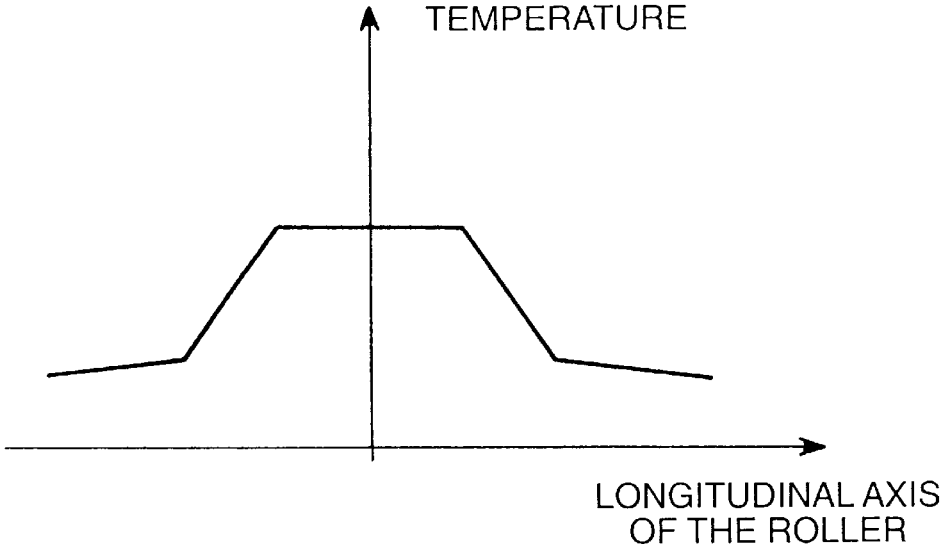
Figure 3B:
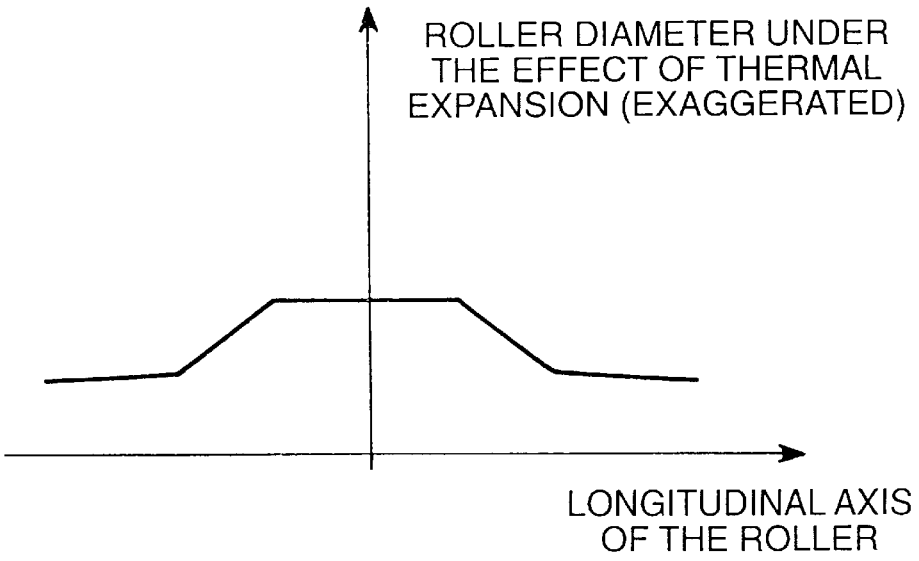
Figure 4:
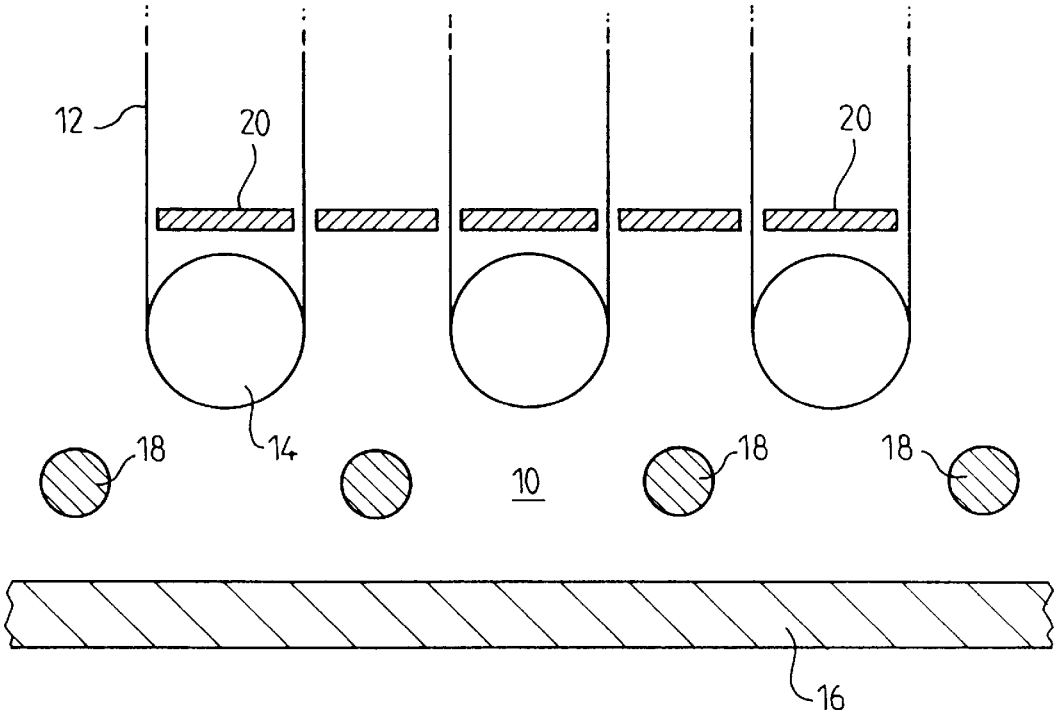

FIG. 3*a* shows the distribution of the temperature along the longitudinal axis of the rolls;

FIG. 3*b* shows the variation in the diameter of the roll due to the effect of thermal expansion (shown exaggerated) along the longitudinal axis of this roll, these FIGS. 3*a* and 3*b* having been commented upon in the preamble of the present description; and FIG. 4 is a diagrammatic partial view showing the apparatus forming the subject of the invention.

DETAILED DESCRIPTION

FIG. 4 shows a cooling furnace to which the present invention is applied.

In this FIG. 4, it may be seen that the strip 12 travels continuously through the chamber of the furnace 10, passing over the rolls such as 14. The reference 16 denotes the furnace hearth. The essential principle on which the invention is based consists in using the strip 12 as a heat shield and in heating only that part of the rolls 14 which is not covered by this strip.

The apparatus forming the subject of the invention therefore comprises heating elements such as 18 which are positioned near the rolls 14 as may be seen in FIG. 4, beneath the latter, over the entire width of the furnace, these heating elements 18 possibly being in the form of electric heat plugs for example. The apparatus furthermore comprises panels such as 20 which are aligned on the opposite side of the rolls 14 from the heating elements 18, these panels being designed and arranged so as, together with the wall of the furnace, to form a warm chamber in order to increase the efficiency of the heating.

According to the present invention, the panels 20 may be made, inter alia, of ceramic fibers held between stainless steel sheets.

According to the present invention, the rolls 14 may be heated, as described above, continuously or intermittently depending on the frequency of the changes of width. Thus, two cases may arise:

first case: frequent changes of strip width: continuous use of the heating;

second case: infrequent changes of strip width: the heating is used for a predetermined time immediately before the change of width.

According to the present invention, the heating system, such as 18, for heating the rolls 14 may be controlled in real time by a computer.

It will be observed that heating the strip, such as 12, in a cooling furnace reduces the cooling capacity of the furnace, However, this reduction is insignificant and in no way impairs the effectiveness of the apparatus forming the subject of the present invention.

It remains to be stated, of course, that the present invention is not limited to the embodiments described and/or shown but encompasses any variant thereof which falls within the scope of the appended claims.

We claim:

1. Apparatus which eliminates the risk of forming wrinkles on a strip conveyed through a cooling furnace of a continuous heat-treatment plant, especially an annealing or galvanizing furnace, through which the strip is conveyed by rolls, the latter being heated by contact with the strip over its width, the risk of forming wrinkles occuring during a change of strip width when the following strip is wider, the latter consequently passing over rolls that have preserved the imprint of the thermal expansion due to the previous strip, wherein the heating elements are positioned close to and beneath the rolls, over the entire width of furnace, and, on the opposite side of the rolls from the said heating elements, panels are positioned which are aligned so as, together with the wall of the furnace, to form a warm chamber, the continuously moving strip serving as a heat shield so that only that part of the roll which is not covered by the strip is heated by the said heating elements.

2. Apparatus according to claim 1, wherein said heating elements are made in the form of electric heat plugs.

3. Apparatus according to claim 1, wherein the rolls are heated by said heating elements continuously or intermittently depending on the frequency of the changes of strip width.

4. Apparatus according to claim 3, wherein said heating elements operate continuously during frequent changes of width.

5. Apparatus according to claim 3, wherein said heating elements operate intermittently during infrequent changes of width, the heating being used for a predetermined time immediately before the change of strip width.

6. Apparatus according to claim 1, wherein the operation of said heating elements is controlled in real time by a computer.

7. Apparatus according to claim 1, wherein said panels are made of ceramic fibers held between stainless steel sheets.

* * * * *